US010086972B2

(12) United States Patent
Hajek

(10) Patent No.: US 10,086,972 B2
(45) Date of Patent: Oct. 2, 2018

(54) CARTON WITH LOCKING FEATURE

(71) Applicant: Graphic Packaging International, Inc., Atlanta, GA (US)

(72) Inventor: Ronald E. Hajek, Joliet, IL (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 15/176,715

(22) Filed: Jun. 8, 2016

(65) Prior Publication Data

US 2016/0362217 A1 Dec. 15, 2016

Related U.S. Application Data

(60) Provisional application No. 62/230,598, filed on Jun. 9, 2015.

(51) Int. Cl.
*B65D 5/00* (2006.01)
*B65D 5/20* (2006.01)
(Continued)

(52) U.S. Cl.
CPC ..... *B65D 5/0085* (2013.01); *B65D 5/2057* (2013.01); *B65D 5/302* (2013.01); *B65D 5/4266* (2013.01); *B65D 5/667* (2013.01)

(58) Field of Classification Search
CPC .. B65D 5/0085; B65D 5/4266; B65D 5/2057; B65D 5/302; B65D 5/6608
USPC ..... 229/131, 114, 906, 148, 125.29, 149, 229/150, 125.27, 125.28, 154, 195, 902, 229/125.19, 125.32, 920; 493/137
See application file for complete search history.

(56) References Cited

U.S. PATENT DOCUMENTS 1,048,577 A 12/1912 Pardoe
1,656,919 A 1/1928 Marsh
(Continued)

FOREIGN PATENT DOCUMENTS

DE 1 586 447 4/1970
DE 2 320 190 11/1973
(Continued)

OTHER PUBLICATIONS

International Search Report and Written Opinion for PCT/US2016/036394 dated Oct. 18, 2016.

*Primary Examiner* — Christopher Demeree
(74) *Attorney, Agent, or Firm* — Womble Bond Dickinson (US) LLP

(57) ABSTRACT

In one aspect, the disclosure is generally directed to a carton for holding at least one article. The carton comprising a plurality of panels comprising a bottom panel, a front panel foldably connected to the bottom panel, at least one back panel, a top panel, a lid panel foldably connected to the top panel. At least one end flap is foldably connected to a respective panel of the plurality of panels. A base comprises at least the bottom panel, and the front panel. A lid is pivotably attached to the base. The lid comprises the top panel and the lid panel and is movable between a closed position preventing access to the base and an open position allowing access to the base. Locking features are for releasably attaching the lid to the base in the closed position. The locking features comprises at least one male portion in the front panel and at least one female portion in the at least one end flap.

46 Claims, 12 Drawing Sheets

(51) Int. Cl.

| | |
|---|---|
| ***B65D 5/30*** | (2006.01) |
| ***B65D 5/42*** | (2006.01) |
| ***B65D 5/66*** | (2006.01) |

(56) References Cited

U.S. PATENT DOCUMENTS 1,772,625 A 8/1930 Caulfield
1,793,102 A 2/1931 Labombarde
1,901,483 A 3/1933 Ware, Jr.
1,925,102 A 9/1933 Levkoff
2,027,079 A 1/1936 Weiss
2,054,596 A 9/1936 Ford
2,139,021 A 12/1938 Johnson
2,141,743 A 12/1938 Ethridge
2,145,430 A 1/1939 New
2,152,079 A 3/1939 Mott
2,180,808 A 11/1939 Jacobstein et al.
2,192,722 A 3/1940 Vogt
2,194,220 A 3/1940 Elder
2,251,283 A 8/1941 Johnson
2,292,573 A 8/1942 Kondolf
2,335,913 A 12/1943 Buttery
2,337,892 A 12/1943 Hultin
2,345,486 A 3/1944 Nathan
2,355,665 A 8/1944 Mabee
2,396,310 A 3/1946 Gibson
2,437,926 A 3/1948 Ball et al.
2,594,394 A 4/1952 Casselman et al.
2,777,630 A 1/1957 Moberger
2,835,594 A 5/1958 Felt et al.
2,877,736 A 3/1959 Simmons
2,887,389 A 5/1959 Linville
2,964,231 A 12/1960 Hanselman, Jr. et al.
2,973,086 A 2/1961 Thompson
2,990,992 A 7/1961 Ellis
2,999,626 A 9/1961 McDermott
3,002,613 A 10/1961 Merkel
3,013,712 A 12/1961 Wollaeger
3,021,002 A 2/1962 Guyer
3,027,062 A 3/1962 Huss et al.
3,033,362 A 5/1962 Marcalus
3,071,882 A 1/1963 Eisman et al.
3,099,381 A 7/1963 Meyers
3,131,851 A 5/1964 Pace
3,131,852 A 5/1964 Forbes, Jr.
3,139,979 A 7/1964 Russell
3,164,316 A 1/1965 Wurster et al.
3,180,556 A 4/1965 Asman
3,181,772 A 5/1965 Collins et al.
3,185,382 A 5/1965 Nunn
3,193,175 A 7/1965 Moreton
3,205,603 A 9/1965 Brumley
3,206,096 A 9/1965 Struble
3,206,103 A 9/1965 Bixler
3,215,332 A 11/1965 Bess
3,228,710 A 1/1966 Chodorowski
3,263,900 A 8/1966 Link et al.
3,276,665 A 10/1966 Rasmussen
3,280,968 A 10/1966 Craine
3,310,222 A 3/1967 Buttery
3,310,223 A 3/1967 Buttery
3,325,081 A 6/1967 Mahon
3,355,089 A 11/1967 Champlin
3,363,822 A 1/1968 Maulini et al.
3,409,205 A 11/1968 Meyers
3,410,476 A 11/1968 Buttery
3,426,955 A 2/1969 Olson
3,486,682 A 12/1969 Whipperman
3,524,581 A 8/1970 Buttery
3,578,234 A 5/1971 Marchisen
3,596,823 A 8/1971 Zitzelman
3,653,495 A 4/1972 Gray
3,669,345 A 6/1972 Cole
3,677,458 A 7/1972 Gosling
3,680,766 A 8/1972 Collura et al.
3,690,544 A 9/1972 Meyers
3,693,865 A 9/1972 Desmond et al.
3,734,390 A 5/1973 Buttery et al.
3,759,378 A 9/1973 Werth
3,768,719 A 10/1973 Johnson
3,786,914 A 1/1974 Beutler
3,840,172 A 10/1974 Zimmermann
3,884,438 A 5/1975 Logsdon
3,958,744 A 5/1976 Herglotz
3,981,434 A 9/1976 Ramich
D241,821 S 10/1976 Jewell
4,004,691 A 1/1977 Wihksne
4,008,849 A 2/1977 Baber
4,046,313 A 9/1977 Perry
4,111,297 A 9/1978 Paulin
4,113,100 A 9/1978 Soja
4,232,816 A 11/1980 Johnson et al.
4,262,816 A 4/1981 Margulies
4,266,713 A 5/1981 Maroszek
4,271,964 A 6/1981 Train
4,289,240 A 9/1981 Mueller
4,339,068 A 7/1982 Brauner
4,344,537 A 8/1982 Austin
4,470,538 A 9/1984 Heathcock et al.
4,472,896 A 9/1984 Brauner et al.
4,477,017 A 10/1984 Webinger
4,484,683 A 11/1984 Werner, Jr.
4,508,218 A 4/1985 Focke et al.
4,512,476 A 4/1985 Herrington, Jr.
4,519,538 A 5/1985 Omichi
4,558,785 A 12/1985 Gordon
4,570,845 A 2/1986 Hall
4,572,423 A 2/1986 Spencer
4,584,202 A 4/1986 Roccaforte
4,621,736 A 11/1986 Roccaforte
4,630,733 A 12/1986 Fear
4,645,108 A 2/1987 Gavin et al.
4,669,614 A 6/1987 Froom
4,676,394 A 6/1987 Hiersteiner
4,684,023 A 8/1987 Cortopassi
4,717,070 A 1/1988 Taub
4,742,917 A 5/1988 Bornwasser
4,746,019 A 5/1988 Prater
4,749,086 A 6/1988 Donohie
4,757,902 A 7/1988 Hutchinson et al.
4,768,703 A 9/1988 Sosler et al.
4,773,541 A 9/1988 Riddell
4,792,085 A 12/1988 Waring et al.
4,793,487 A 12/1988 Bentsen et al.
4,804,137 A 2/1989 Harby
4,815,609 A 3/1989 Kiedaisch
4,856,707 A 8/1989 Lorenz
4,863,052 A 9/1989 Lambert
4,886,160 A 12/1989 Kligerman
4,901,457 A 2/1990 Chandler
4,905,898 A 3/1990 Wade
4,907,698 A 3/1990 Konrad et al.
4,913,291 A 4/1990 Schuster
4,930,681 A 6/1990 Fultz et al.
4,944,407 A 7/1990 Thiele et al.
4,948,038 A 8/1990 Moeller
4,951,865 A * 8/1990 Eisman ..... B65D 5/667 229/114
4,955,527 A * 9/1990 Blackman ..... B65D 5/667 229/114
5,014,855 A 5/1991 Roccaforte
5,037,026 A 8/1991 Hanko
5,039,003 A * 8/1991 Gordon ..... B65D 5/48024 229/114
D320,743 S 10/1991 Alexander et al.
5,058,803 A 10/1991 Gulliver
5,060,851 A 10/1991 Lorenz
5,097,958 A 3/1992 Josephs et al.
RE33,979 E 6/1992 Cortopassi
5,160,081 A 11/1992 Beales
5,161,734 A 11/1992 Ruehl et al.
5,181,650 A 1/1993 Hollander et al.
5,188,284 A 2/1993 Eisman
5,265,799 A 11/1993 Stone

(56) References Cited

U.S. PATENT DOCUMENTS

| | | | |
|---|---|---|---|
| D342,446 | S | 12/1993 | Parker et al. |
| D344,023 | S | 2/1994 | Eisman |
| D346,552 | S | 5/1994 | Krupa |
| D348,609 | S | 7/1994 | Eisman et al. |
| 5,330,099 | A | 7/1994 | Beales et al. |
| 5,332,147 | A | 7/1994 | Sorenson |
| 5,347,865 | A | 9/1994 | Mulry et al. |
| 5,356,022 | A | 10/1994 | Tipps |
| 5,363,981 | A | 11/1994 | Giblin et al. |
| 5,364,018 | A | 11/1994 | Carlsson |
| 5,368,194 | A | 11/1994 | Oliff et al. |
| 5,373,960 | A | 12/1994 | Gunn et al. |
| 5,388,758 | A | 2/1995 | Scovell |
| 5,427,267 | A | 6/1995 | Willman |
| 5,467,916 | A | 11/1995 | Beales |
| D365,272 | S | 12/1995 | Krupa et al. |
| 5,484,102 | A | 1/1996 | DeMay |
| 5,553,772 | A | 9/1996 | Jensen |
| 5,632,402 | A | 5/1997 | Walsh et al. |
| 5,632,404 | A | 5/1997 | Walsh |
| 5,662,265 | A | 9/1997 | Jensen |
| 5,690,273 | A | 11/1997 | Jensen |
| 5,692,672 | A | 12/1997 | Hunt |
| 5,697,549 | A | 12/1997 | Yocum |
| 5,699,957 | A | 12/1997 | Blin et al. |
| 5,722,583 | A | 3/1998 | Focke et al. |
| 5,746,871 | A | 5/1998 | Walsh |
| 5,783,030 | A | 7/1998 | Walsh |
| 5,788,117 | A | 8/1998 | Zimmanck |
| 5,788,145 | A | 8/1998 | Grahahm et al. |
| 5,794,811 | A | 8/1998 | Walsh |
| 5,794,812 | A | 8/1998 | Walsh |
| 5,826,781 | A | 10/1998 | Jensen |
| 5,842,576 | A | 12/1998 | Snow |
| 5,857,570 | A | 1/1999 | Brown |
| 5,857,614 | A | 1/1999 | Walsh |
| 5,878,947 | A | 3/1999 | Hoy et al. |
| 5,881,884 | A | 3/1999 | Podosek |
| 5,918,799 | A | 7/1999 | Walsh |
| 5,921,398 | A | 7/1999 | Carroll |
| 5,927,498 | A | 7/1999 | Saam |
| 5,960,555 | A | 10/1999 | Deaton et al. |
| 5,979,749 | A | 11/1999 | Bozich |
| 5,996,797 | A | 12/1999 | Flaig |
| 6,027,018 | A | 2/2000 | Yocum |
| 6,041,997 | A | 3/2000 | Jensen |
| 6,068,181 | A | 5/2000 | Cai |
| 6,092,719 | A | 7/2000 | Capo |
| 6,102,277 | A | 8/2000 | Krapohl, Sr. |
| D431,462 | S | 10/2000 | Menaged et al. |
| 6,129,211 | A | 10/2000 | Prakken et al. |
| 6,135,289 | A | 10/2000 | Miller |
| 6,349,875 | B1 | 2/2002 | Whitnell |
| 6,352,096 | B1 | 3/2002 | Walsh |
| 6,364,202 | B1 | 4/2002 | Zelley |
| 6,386,441 | B2 | 5/2002 | Philips |
| D458,127 | S | 6/2002 | de Groote |
| D460,691 | S | 7/2002 | Morris et al. |
| 6,419,152 | B1 | 7/2002 | Tokarski |
| 6,435,351 | B1 | 8/2002 | Gibb |
| 6,478,159 | B1 | 11/2002 | Taylor |
| 6,481,259 | B1 | 11/2002 | Durney |
| D467,499 | S | 12/2002 | Garza et al. |
| 6,510,982 | B2 | 1/2003 | White |
| 6,520,404 | B1 | 2/2003 | Waldburger et al. |
| 6,523,692 | B2 | 2/2003 | Gregory |
| D473,787 | S | 4/2003 | Jones, Jr. et al. |
| 6,568,586 | B1 | 5/2003 | VanEsley et al. |
| 6,588,652 | B2 | 7/2003 | Cai |
| D484,043 | S | 12/2003 | Hwang et al. |
| 6,681,983 | B2 | 1/2004 | Bill-Moore |
| 6,761,269 | B2 | 7/2004 | Hamming |
| 6,834,793 | B2 | 12/2004 | Sutherland |
| 6,854,639 | B2 | 2/2005 | Walsh |
| 6,869,009 | B2 | 3/2005 | Sutherland et al. |
| 6,913,189 | B2 | 7/2005 | Oliff et al. |
| 6,913,190 | B2 | 7/2005 | Ruhbusch et al. |
| 6,923,365 | B2 | 8/2005 | Auclair et al. |
| 7,021,468 | B2 | 4/2006 | Cargile |
| 7,025,504 | B2 | 4/2006 | Olin |
| 7,225,930 | B2 | 6/2007 | Ford et al. |
| 7,232,054 | B2 | 6/2007 | Yocum |
| 7,328,834 | B2 | 2/2008 | Harrelson |
| 7,407,087 | B2 | 8/2008 | DeBusk et al. |
| 7,416,109 | B2 | 8/2008 | Sutherland |
| 7,669,755 | B2 | 3/2010 | Smalley |
| 7,699,214 | B2 | 4/2010 | Mestre et al. |
| 7,703,665 | B2 | 4/2010 | McGowan |
| 7,743,944 | B2 | 6/2010 | Ho Fung et al. |
| 7,784,675 | B2 | 8/2010 | Sutherland et al. |
| 7,980,452 | B2 | 7/2011 | Burton |
| 8,002,171 | B2 | 8/2011 | Ryan et al. |
| 8,006,893 | B2 | 8/2011 | Burke et al. |
| 8,056,799 | B2 | 11/2011 | Burke et al. |
| 8,146,743 | B2 | 4/2012 | Stonehouse |
| 8,523,049 | B2 | 9/2013 | Fitzwater |
| 8,672,215 | B2 | 3/2014 | Learn |
| 8,733,626 | B2 | 5/2014 | Learn |
| 8,740,050 | B2 | 6/2014 | Zinck et al. |
| 8,820,617 | B2 | 9/2014 | Silverstein et al. |
| 8,820,621 | B2 | 9/2014 | Burke et al. |
| 9,139,330 | B2 | 9/2015 | Gomez |
| 9,233,515 | B2 | 1/2016 | Cook et al. |
| 9,320,373 | B2 | 4/2016 | Burke et al. |
| 9,346,234 | B2 | 5/2016 | Hajek et al. |
| 9,540,135 | B2 * | 1/2017 | Robertson ..... B65D 5/6685 |
| 2001/0001447 | A1 | 5/2001 | Gregory |
| 2001/0048022 | A1 | 12/2001 | Zoeckler |
| 2002/0036153 | A1 | 3/2002 | Yang |
| 2002/0043554 | A1 | 4/2002 | White et al. |
| 2002/0055429 | A1 | 5/2002 | Walsh |
| 2002/0170845 | A1 | 11/2002 | Oliff |
| 2003/0047595 | A1 | 3/2003 | Bill-Moore |
| 2003/0144121 | A1 | 7/2003 | Walsh et al. |
| 2004/0007614 | A1 | 1/2004 | Saulas |
| 2004/0074953 | A1 | 4/2004 | Yocum |
| 2004/0099570 | A1 | 5/2004 | Cargile |
| 2004/0226989 | A1 | 11/2004 | Cook et al. |
| 2005/0092649 | A1 | 5/2005 | Ford et al. |
| 2005/0109827 | A1 | 5/2005 | Martin |
| 2005/0187087 | A1 | 8/2005 | Walsh |
| 2005/0199690 | A1 | 9/2005 | Peterson |
| 2006/0049067 | A1 | 3/2006 | McDonald |
| 2006/0243739 | A1 | 11/2006 | Sherman et al. |
| 2006/0243783 | A1 | 11/2006 | Spivey, Sr. et al. |
| 2006/0255105 | A1 | 11/2006 | Sweet |
| 2006/0255107 | A1 | 11/2006 | Wright |
| 2006/0266810 | A1 | 11/2006 | Foushee |
| 2006/0266815 | A1 | 11/2006 | Coltri-Johnson et al. |
| 2007/0000934 | A1 | 1/2007 | Wolpow |
| 2007/0012755 | A1 | 1/2007 | Metcalf |
| 2007/0108262 | A1 | 5/2007 | D'Amato |
| 2007/0267467 | A1 | 11/2007 | Burke et al. |
| 2009/0001145 | A1 | 1/2009 | Hasse et al. |
| 2013/0193197 | A1 | 8/2013 | Low et al. |
| 2016/0130027 | A1 | 5/2016 | Burke |
| 2016/0130028 | A1 | 5/2016 | Burke |
| 2016/0251108 | A1 | 9/2016 | Gungner |

FOREIGN PATENT DOCUMENTS

| | | |
|---|---|---|
| DE | 29 23 455 | 12/1980 |
| DE | 81 10 323.9 | 9/1981 |
| DE | 87 08 078.8 | 10/1987 |
| DE | 94 13 813 | 10/1994 |
| EP | 0 406 556 | 1/1991 |
| EP | 0 520 131 | 12/1992 |
| EP | 0 704 386 | 4/1996 |
| EP | 1 457 425 | 9/2004 |
| EP | 1 785 359 B1 | 8/2009 |
| FR | 1 379 931 | 12/1963 |
| FR | 2 659 062 | 9/1991 |
| FR | 2 699 150 | 6/1994 |
| FR | 2 755 670 | 5/1998 |

(56) References Cited

FOREIGN PATENT DOCUMENTS

| | | | |
|---|---|---|---|
| GB | 104 445 | | 3/1917 |
| GB | 1 218 016 | | 1/1971 |
| GB | 1 242 356 | | 8/1971 |
| GB | 1 489 963 | | 10/1977 |
| GB | 1 584 066 | | 2/1981 |
| GB | 2 137 172 | A | 10/1984 |
| GB | 2 321 237 | | 7/1998 |
| GB | 2 363 372 | | 12/2001 |
| JP | S52-039054 | | 3/1952 |
| JP | S52-096178 | | 8/1977 |
| JP | S54-079106 | | 6/1979 |
| JP | 06-037127 | U | 5/1994 |
| JP | H06-87221 | | 12/1994 |
| JP | H7-28016 | | 5/1995 |
| JP | 07-315371 | A | 12/1995 |
| JP | H08-113246 | | 5/1996 |
| JP | 08-268426 | A | 10/1996 |
| JP | 2002-87427 | | 3/2002 |
| JP | 2010-0184713 | A | 8/2010 |
| JP | 2011-084279 | A | 4/2011 |
| KR | 20-0332055 | Y1 | 11/2003 |
| KR | 10-2008-0114121 | A | 12/2008 |
| WO | WO 92/06896 | | 4/1992 |
| WO | WO 95/28325 | | 10/1995 |
| WO | WO 98/31593 | | 7/1998 |
| WO | WO 03/082686 | | 10/2003 |
| WO | WO 2004/063031 | | 7/2004 |
| WO | WO 2005/110866 | | 11/2005 |
| WO | WO 2006/073506 | | 7/2006 |
| WO | WO 2006/133401 | | 12/2006 |
| WO | WO 2012/024206 | A2 | 2/2012 |

* cited by examiner

CARTON WITH LOCKING FEATURE

CROSS REFERENCE TO RELATED APPLICATIONS

This application claims the benefit of U.S. Provisional Patent Application No. 62/230,598 filed Jun. 9, 2015.

INCORPORATION BY REFERENCE

The disclosure of U.S. Provisional Patent Application No. 62/230,598, which was filed Jun. 9, 2015, is hereby incorporated by reference for all purposes as if presented herein in its entirety.

BACKGROUND OF THE DISCLOSURE

The present invention generally relates to packages or cartons for holding and dispensing one or more products, such as food products. More specifically, the present disclosure relates to cartons with reclosable locking features.

SUMMARY OF THE DISCLOSURE

In one aspect, the disclosure is generally directed to a carton for holding at least one article. The carton comprising a plurality of panels comprising a bottom panel, a front panel foldably connected to the bottom panel, at least one back panel, a top panel, a lid panel foldably connected to the top panel. At least one end flap is foldably connected to a respective panel of the plurality of panels. A base comprises at least the bottom panel, and the front panel. A lid is pivotably attached to the base. The lid comprises the top panel and the lid panel and is movable between a closed position preventing access to the base and an open position allowing access to the base. Locking features are for releasably attaching the lid to the base in the closed position. The locking features comprises at least one male portion in the front panel and at least one female portion in the at least one end flap.

In another aspect, the disclosure is generally directed to a blank for forming a carton for holding at least one article. The blank comprises a plurality of panels comprising a bottom panel, a front panel foldably connected to the bottom panel, at least one back panel, a top panel, a lid panel foldably connected to the top panel. At least one end flap is foldably connected to a respective panel of the plurality of panels. Base features are for forming a base in the carton formed from the blank. The base features comprising at least the bottom panel, and the front panel. Lid features are for forming a lid in the carton formed from the blank. The lid is pivotably attached to the base. The lid features comprising the top panel and the lid panel. The lid is movable between a closed position preventing access to the base and an open position allowing access to the base. Locking features are for releasably attaching the lid to the base in the closed position. The locking features comprises at least one male portion in the front panel and at least one female portion in the at least one end flap.

In another aspect, the disclosure is generally directed to a method of forming a carton. The method comprises obtaining a blank comprising a plurality of panels comprising a bottom panel, a front panel foldably connected to the bottom panel, at least one back panel, a top panel, a lid panel foldably connected to the top panel. At least one end flap is foldably connected to a respective panel of the plurality of panels. The blank comprising base features, lid features, and locking features. The base features comprise at least the bottom panel, and the front panel. The lid features comprise the top panel and the lid panel. The locking features comprise at least one male portion in the front panel and at least one female portion in the at least one end flap. The method comprises forming the base by positioning the front panel relative to the bottom panel and forming the lid by positioning the lid panel relative to the top panel. The lid is pivotably attached to the base and movable between a closed position preventing access to the base and an open position allowing access to the base. The method comprises releasably attaching the lid to the base in the closed position by engaging the locking features.

Those skilled in the art will appreciate the above stated advantages and other advantages and benefits of various additional embodiments from reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

The present disclosure relates generally to various aspects of materials, blanks, packages, cartons, constructs, etc., for holding food items, and methods of making such materials, blanks, packages, cartons, and constructs. Although several different disclosures, aspects, implementations, and embodiments are provided, numerous interrelationships between, combinations thereof, and modifications of the various disclosures, aspects, implementations, and embodiments are contemplated hereby. In this specification, the terms "lower," "bottom," "upper," "top," "front," and "back," or other terms of orientation, indicate orientations determined in relation to fully erected cartons or packages and any such indication of orientations is not intended to limit the scope of the disclosure as the cartons or packages disclosed herein are capable of different orientations than shown and/or described herein.

Figures 1, 1A, 1B:
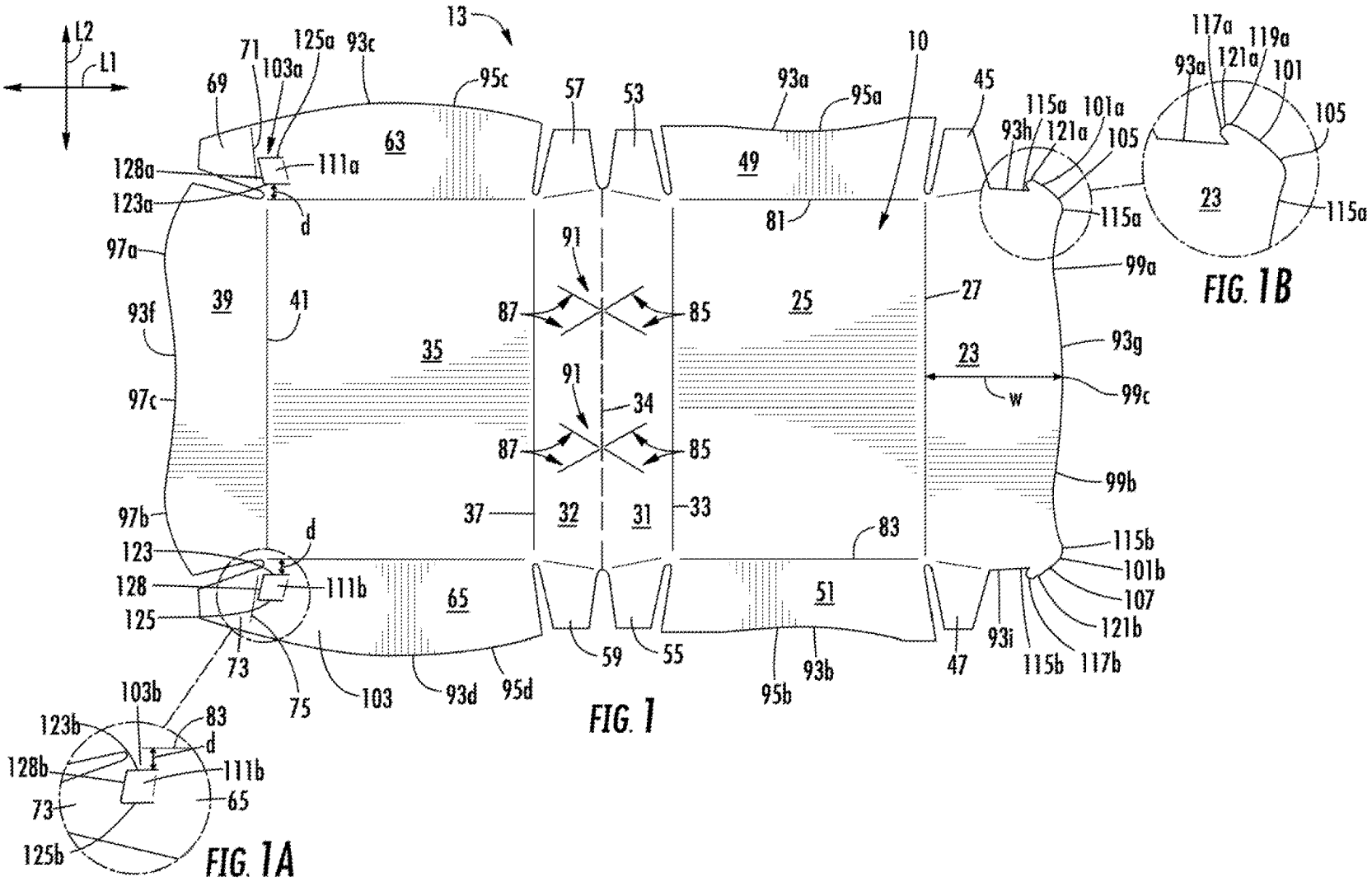
FIG. 1 is plan view of exterior surface of a blank according to an embodiment of the present disclosure.
FIG. 1A is a close-up view of a female locking portion according to an embodiment of the present disclosure.
FIG. 1B is a close-up view of a male locking portion according to an embodiment of the present disclosure.

FIG. 1 shows an exterior surface 10 of a blank 13 for forming a carton 15 (FIGS. 5-9), which may be referred to as a "clamshell" carton. In one embodiment, the carton 15 may be useful for holding one or more food products such as sandwiches (e.g., paninis, bagels, flatbreads, etc.) or one or more nonfood products, or any other suitable article that may be placed in the carton 15 for service to a customer. The products can be contained in additional packaging and then placed in the carton 15. The carton 15 can include various dispensing features and various opening/closing features. The carton 15 has a reclosable lid 135 pivotably attached to a base 133. The lid 135 is movable between a closed position preventing access to the base 133 and an open position allowing access to the base. The lid 135 is that has various locking and engagement features for releasably attaching the lid to the base 133 in the closed position as described below. The carton 15 could be otherwise shaped and arranged and could be used to hold other food products in other environments without departing from the disclosure.

As shown in FIG. 1, the blank 13 has a longitudinal axis L1 extending generally in the direction of the length of the blank and a lateral axis L2 extending generally in the direction of the width of the blank. In one embodiment, the blank 13 comprises a front panel 23, a bottom panel 25, a first back panel 31, a second back panel 32, a top panel 35, and a lid panel 39. The bottom panel 25 is foldably connected to the front panel 23 at a lateral fold line 27, the first back panel 31 is foldably connected to the bottom panel 25 at a lateral fold line 33, the second back panel 32 is foldably connected to the first back panel 31 at a lateral fold line 34, the top panel 35 is foldably connected to the second back panel 32 at a lateral fold line 37, and the lid panel 39 is foldably connected to the top panel 35 at a lateral fold line 41.

In one embodiment, the front panel 23 is foldably connected to a first end flap 45 and a second end flap 47. The bottom panel 25 is foldably connected to a third end flap 49 and a fourth end flap 51. The first back panel 31 is foldably connected to a fifth end flap 53 and a sixth end flap 55. The second back panel 32 is foldably connected to a seventh end flap 57 and an eighth end flap 59. The top panel 35 is foldably connected to a ninth end flap 63 and a tenth end flap 65.

Figure 5:
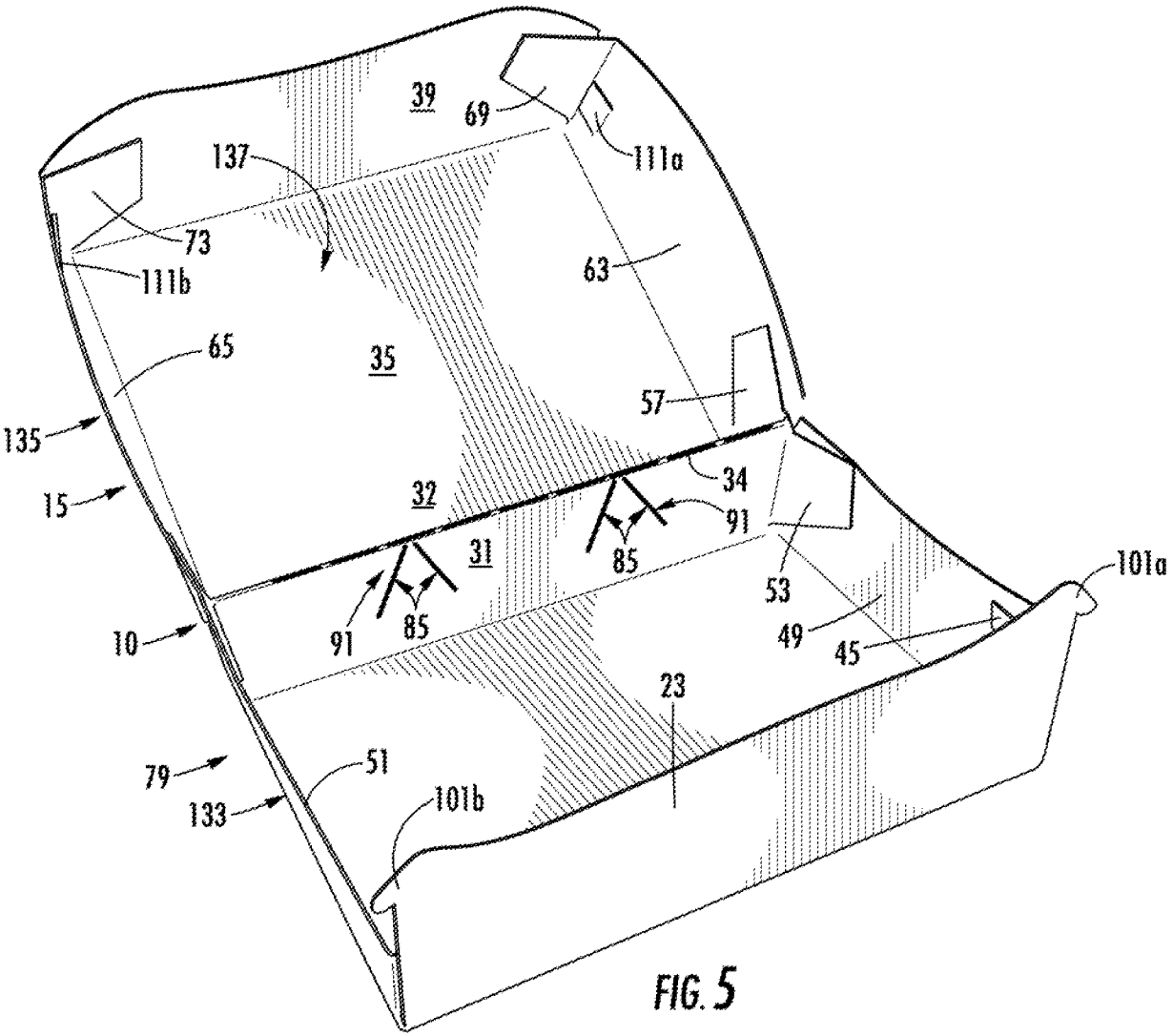
FIG. 5 is perspective view of a fully erected carton in an open configuration according to an embodiment of the present disclosure.
Figure 6:
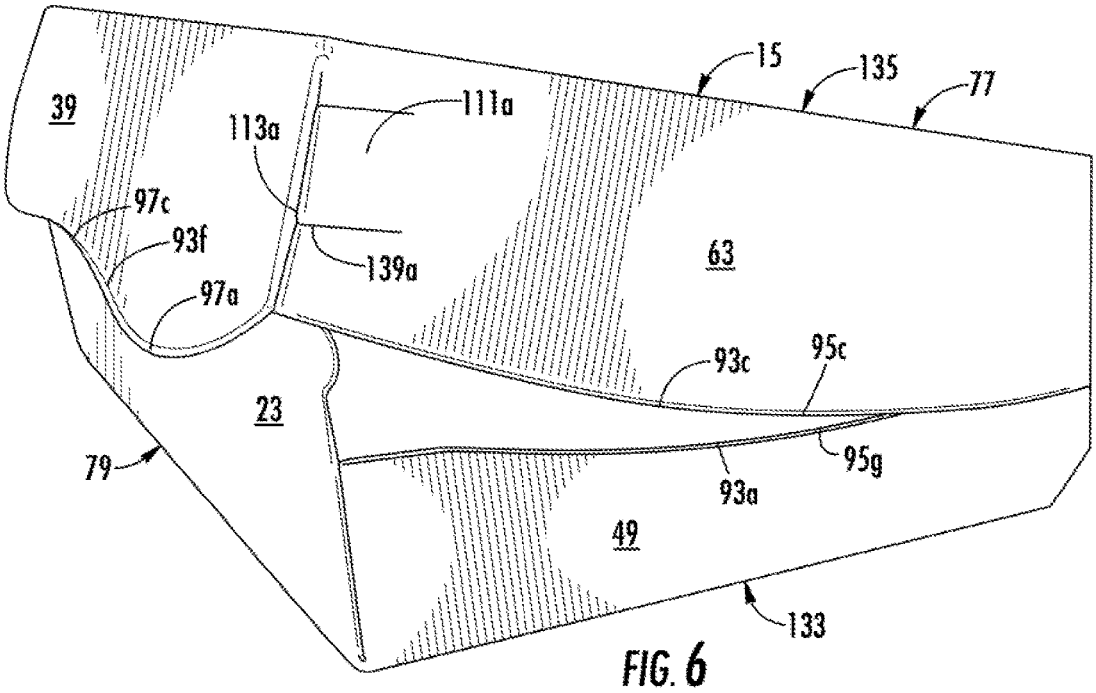
FIG. 6 is a side view of a fully erected carton in a partially open configuration according to an embodiment of the present disclosure.

As illustrated in FIG. 1, the end flap 63 is foldably connected to a first attachment flap 69 at an oblique fold line 71 and the end flap 65 is foldably connected to a second attachment flap 73 at an oblique fold line 75. When the carton 15 is erected, the end flaps 45, 49, 53, 57, 63 and attachment flap 69 close the first end 77 of the carton 15, and the end flaps 47, 51, 55, 59, 65 and attachment flap 73 close the second end 79 of the carton 15. Different flaps arrangements can be used for closing the ends 77, 79 of the carton 15. For example, end flaps 49, 51 could be folded inward after the inward folding of end flaps 45, 47, 53, 55 so that the end flaps 49, 51 are on the exterior of the carton as shown in FIG. 5. Alternatively, the end flaps 45, 47, 53, 55 could be folded after the end flaps 49, 51 so that the end flaps 45, 47, 53, 55 are on the exterior of the carton (not shown).

In the illustrated embodiment, the end flaps 45, 49, 53, 57, 63 extend along a first marginal area of the blank 13 and are foldably connected at a first longitudinal fold line 81 that extends along the length of the blank 13. The end flaps 47, 51, 55, 59, 65 extend along a second marginal area of the blank 13 and are foldably connected at a second longitudinal fold line 83 that also extends along the length of the blank 13. The longitudinal fold lines 81, 83 may be, for example, substantially straight, decoratively curved, or offset at one or more locations to account for the shape of the carton, for blank thickness, or for other factors.

In one embodiment, the first back panel 31 comprises cuts 85 and second back panel 32 comprises cuts 87. As shown in FIG. 1, the cuts 85, 87 are configured in an "X" configuration and define relief portions 91 in the back panels 31, 32. The relief portions 91 prevent the back panels 31, 32 from buckling when the carton is opened or closed. The relief portions 91 could be otherwise shaped, arranged, configured, and/or omitted without departing from the scope of the disclosure.

In one embodiment, the end flaps 49, 51, 63, 65 each comprise a respective outer edge 93*a*, 93*b*, 93*c*, 93*d*. The edges, 93*a*, 93*b* can have a generally concave curved portion 95*a*, 95*b* and the edges 93*c*, 93*d* can have generally convex curved portion 95*c*, 95*d*. The lid panel 39 may comprise an outer edge 93*f* that is curved and may comprise two convex curved portions 97*a*, 97*b* and a concave curved portion 97*c* connecting the convex curved portions 97*a*, 97*b*.

In one embodiment, the front panel 23 comprises an outer edge 93*g*, and side edges 93*h*, 93*i*. In one embodiment, the outer edge 93*g* may be curved and may comprise two concave curved portions 99*a*, 99*b* and a convex curved portion 99*c* connecting the concave curved portions 99*a*, 99*b*. The front panel 23 can have a width "w" that matches the overall depth of the carton such that when the blank 13 is formed into a carton, at least a portion of the outer edge 93*g* is substantially approximate to or in contact with a portion of the top panel 35.

As shown in FIGS. 1-1B, the blank comprises locking features which include male portions 101*a*, 101*b* in the front panel 23 and female portions 103*a*, 103*b* in respective end flaps 63, 65. When the carton is formed from the blank, the locking features are generally located in the ends 77, 79 of the carton. The male portions 101*a*, 101*b* generally extend or project outward from each of the upper corners 105, 107 of the front panel 23. Each of the female portions 103*a*, 103*b* in the end flaps 63, 65 accepts a respective male portions 101*a*, 101*b* forming a respective releasable lock 109*a*, 109*b* (see FIGS. 9 and 10). As discussed in more detail below, the female portions 103*a*, 103*b* include flaps 111*a*, 111*b* that are displaced by the male portions 101*a*, 101*b* when the lid 135 is positioned in the closed position to create openings 113*a*, 113*b* (FIGS. 9 and 10) in the respective end flaps 63, 65.

Figure 7:
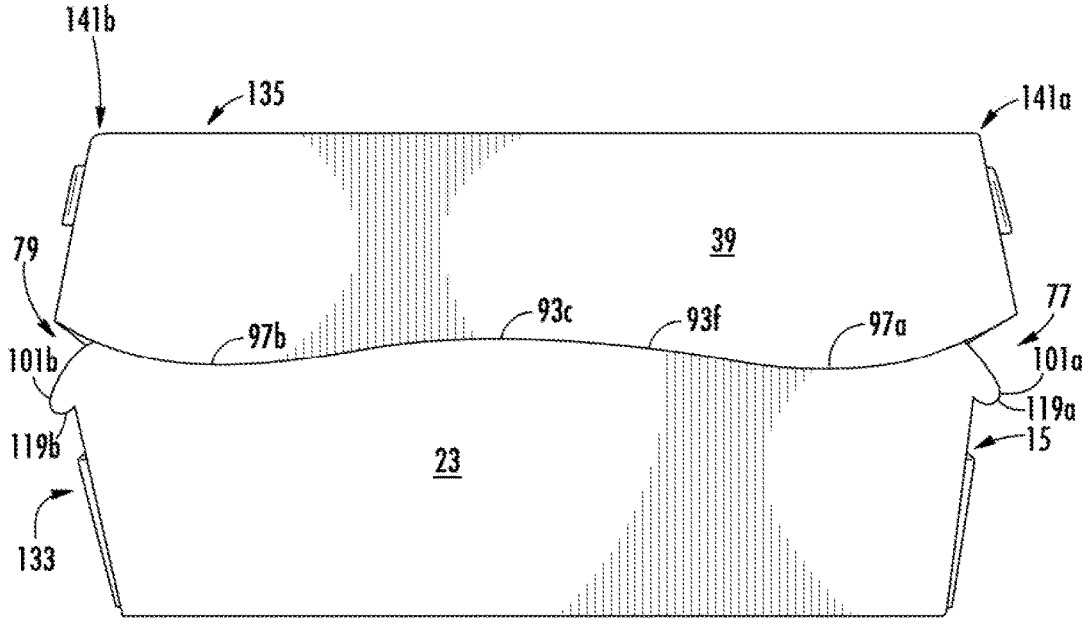
FIG. 7 is a front view of a fully erected carton in a partially open configuration according to an embodiment of the present disclosure.
Figure 8:
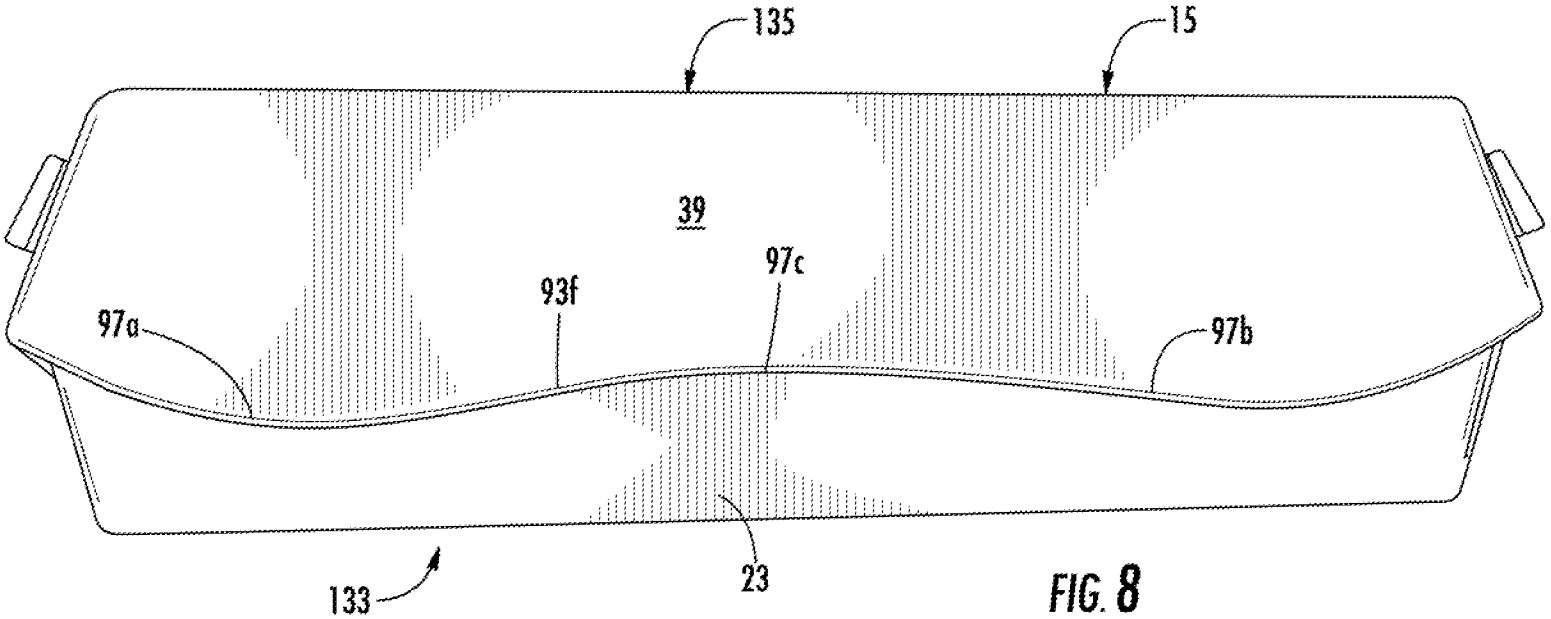
FIG. 8 is a front view of a fully erected carton in a closed configuration according to an embodiment of the present disclosure.

In one embodiment, the male portions 101*a*, 101*b* are projections or tabs that extend outwardly from the side edges 115*a*, 115*b* of the front panel 23. The tabs 101*a*, 101*b* each respectively include a notch 117*a*, 117*b* adjacent the side edges 115*a*, 115*b* and a curved portion 119*a*, 119*b* (FIG. 7). Each of the notches 117*a*, 117*b* and the curved portions 119*a*, 119*b* define a lip 121*a*, 121*b* (i.e., the portion of the tabs 101*a*, 101*b* that engage a portion of the female portions 103*a*, 103*b* when carton 15 is positioned in the closed orientation). The tabs 101*a*, 101*b*, the notches 117*a*, 117*b*, and the curved portions 119*a*, 119*b* could be otherwise shaped, arranged, and/or configured without departing from the scope of the disclosure.

As shown in FIGS. 1 and 1A, the female portions 103*a*, 103*b* of the locking features are located a distance "d" from the respective fold lines 81, 83. The first female portion 103*a* is defined by two longitudinal cuts 123*a*, 125*a* generally extending from respective portions of the oblique fold line 71 and a lateral cut 128*a* extending between the ends of longitudinal cuts 123*a*, 125*a*. The second female portion 103*b* is defined by two longitudinal cuts 123*b*, 125*b* generally extending from respective portions of the oblique fold line 75 and a lateral cut 128*b* extending between the ends of longitudinal cuts 123*b*, 125*b*. The cuts 123*a*, 125*a*, 128*a* and 123*b*, 125*b*, 128*b* define the foldable flaps 111*a* and 111*b* in the respective end flaps 63, 65. The female portions 103*a*, 103*b*, the cuts 123*a*, 125*a*, 128*a*, 123*b*, 125*b*, and the flaps 111*a*, 111*b* could be otherwise shaped, arranged, and/or configured without departing from the disclosure.

Figure 2:
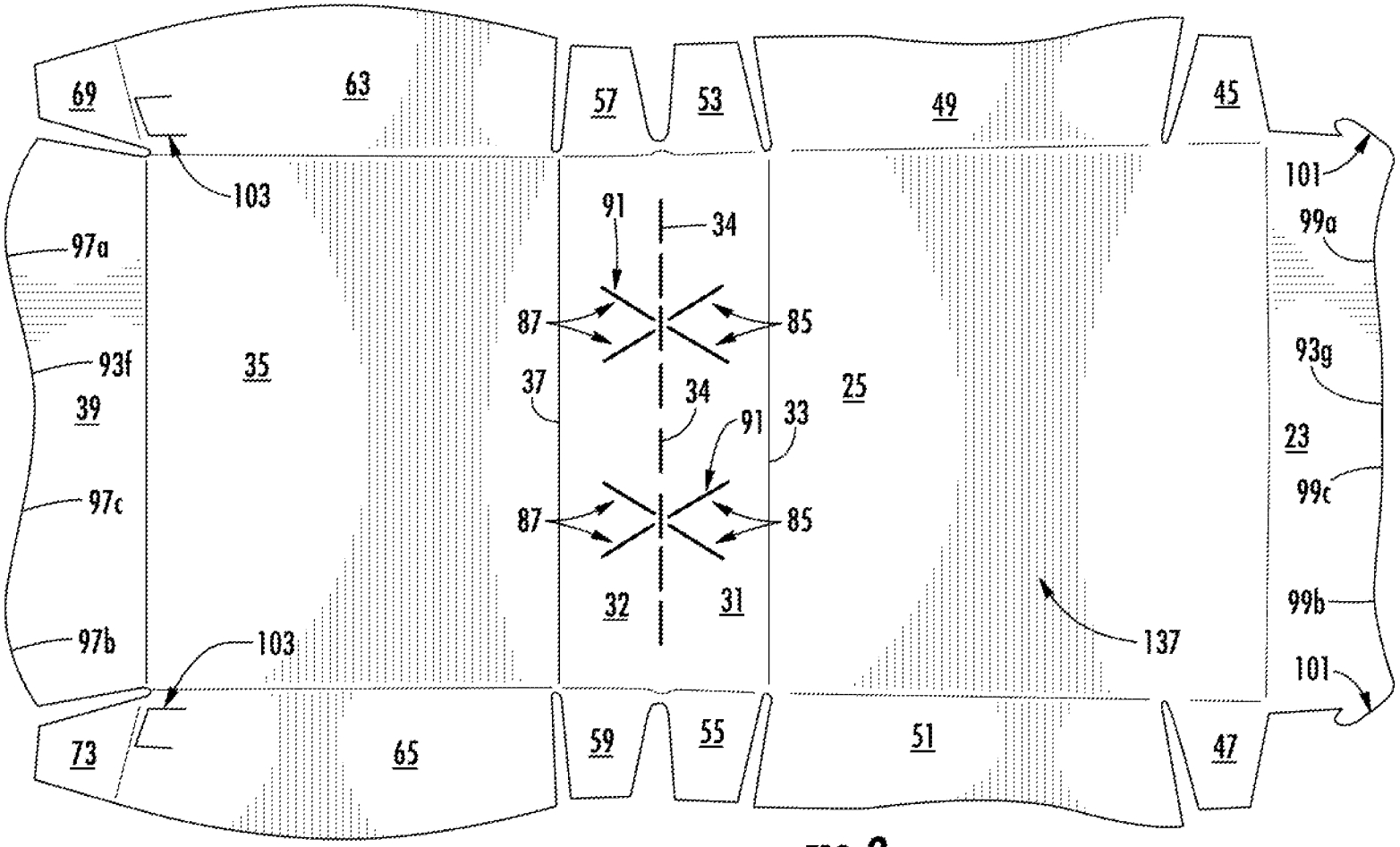
FIG. 2 is a top view of the interior surface of a blank according to an embodiment of the present disclosure.
Figure 3:
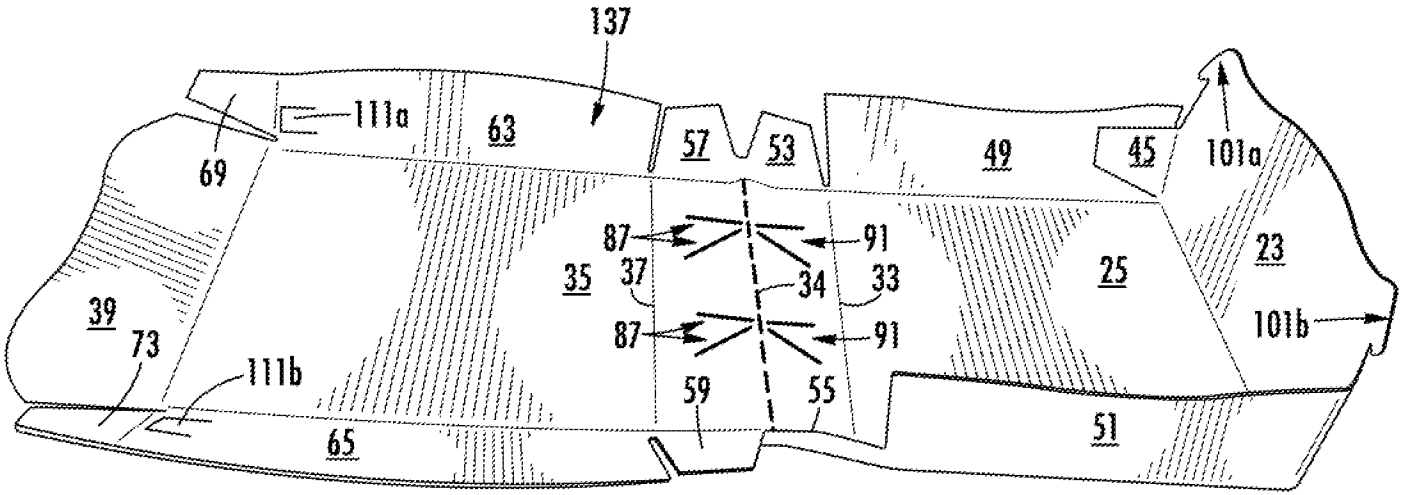
FIG. 3 is a perspective top view of a partially erected carton according to an embodiment of the present disclosure.
Figure 4:
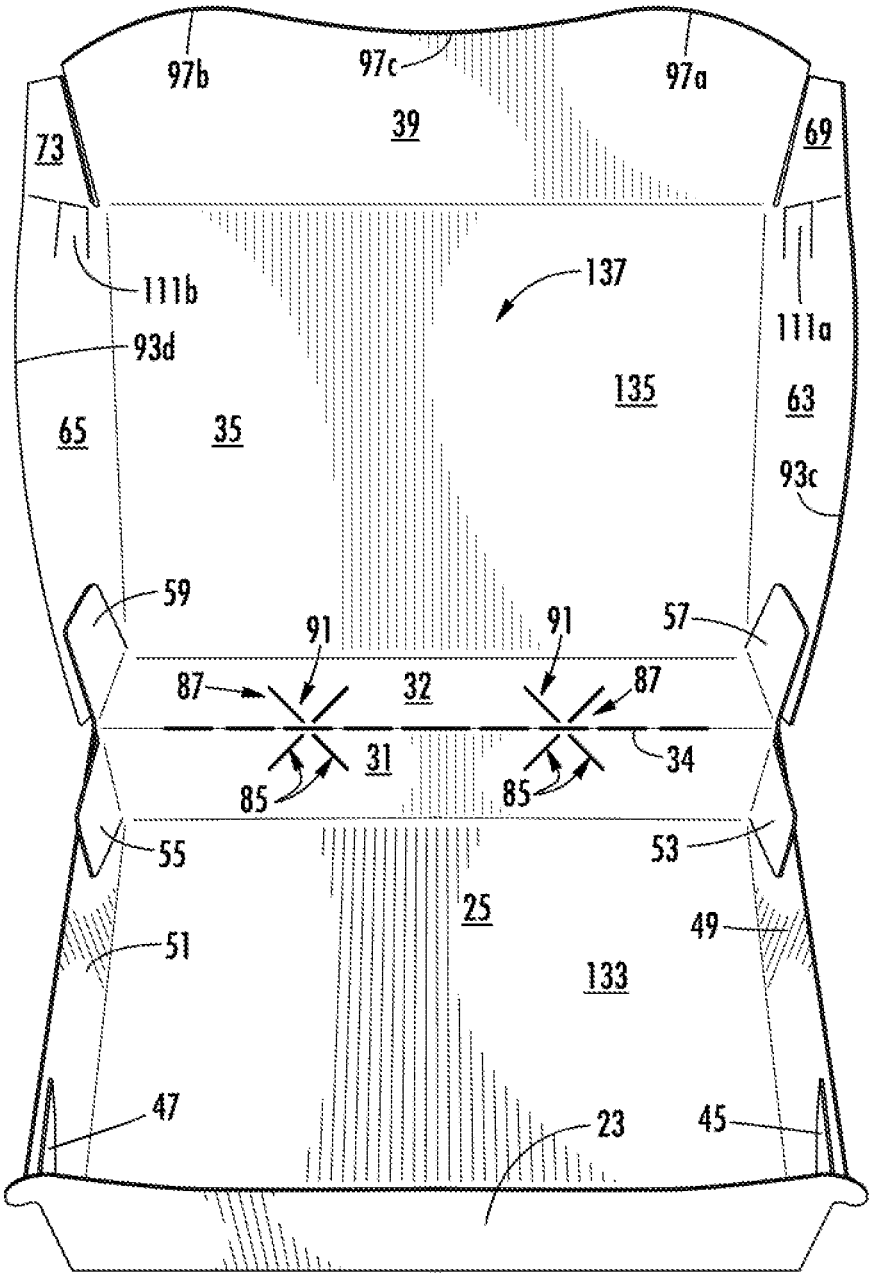
FIG. 4 is perspective top view of a partially erected carton according to an embodiment of the present disclosure.

In one exemplary method of forming the blank 13 into the carton 15 having a base 133 and a reclosable lid 135, the blank 13 is first placed with the interior surface 137 facing up as illustrated in FIG. 2. At least one product (not shown) may be placed on the bottom panel 25, alternatively the product may be placed on the bottom panel after the formation of the carton 15. The base 133 of the carton may be formed prior to or after placing the product F on the bottom panel 25, by upwardly folding the front panel 23 and back panel 31 relative to the bottom panel 25 as illustrated in FIG. 3. The end flaps 45, 53 can be folded inwardly and the end flap 49 may be folded upwardly relative to the bottom panel 25. The end flaps 45, 49, 53 can be positioned to at least partially overlap and to at least partially close a first end 77 of the base 133. The end flaps 47, 55 may be folded inwardly and the end flap 51 may be folded upwardly relative to the bottom panel 25, and end flaps 47, 51, 55 can be positioned to at least partially overlap and to at least partially close a second end 79 of the base 133. The reclosable lid 135 can be formed by upwardly folding the second back panel 32 and the end flaps 63, 65 relative to the top panel 35. The end flaps 57, 59 can be positioned on the inside of and can partially overlap the end flaps 63, 65, respectively. The lid panel 39 can be upwardly folded relative to the top panel 35 along lateral fold line 41, and the attachment flaps 69, 73 can be positioned on the inside of and can partially overlap the lid panel 39. Other folding sequences or configurations could be used without departing from the scope of the disclosure. For example, the end flaps 45, 47, 53, 55, 57, 59 and the attachment flaps 69, 73 can be positioned on the exterior of the carton without departing from the scope of this disclosure.

Figure 9:
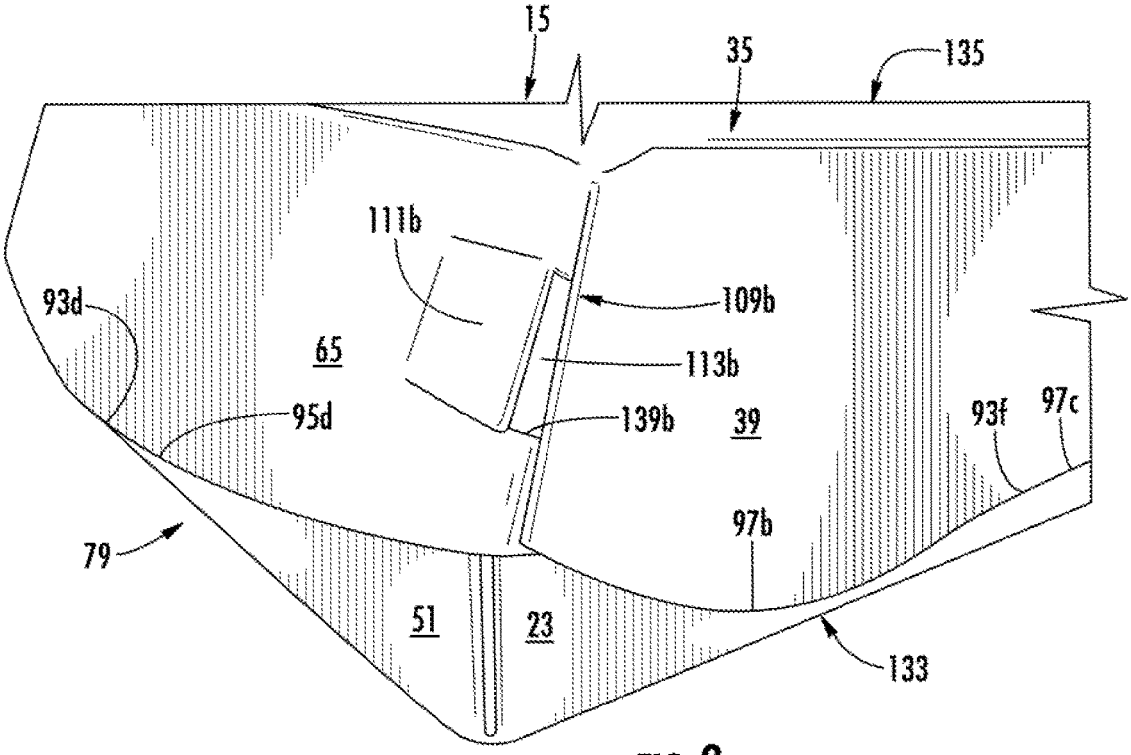
FIG. 9 is perspective view of a first exterior corner of a fully erected carton in a closed configuration according to an embodiment of the present disclosure.
Figure 10:
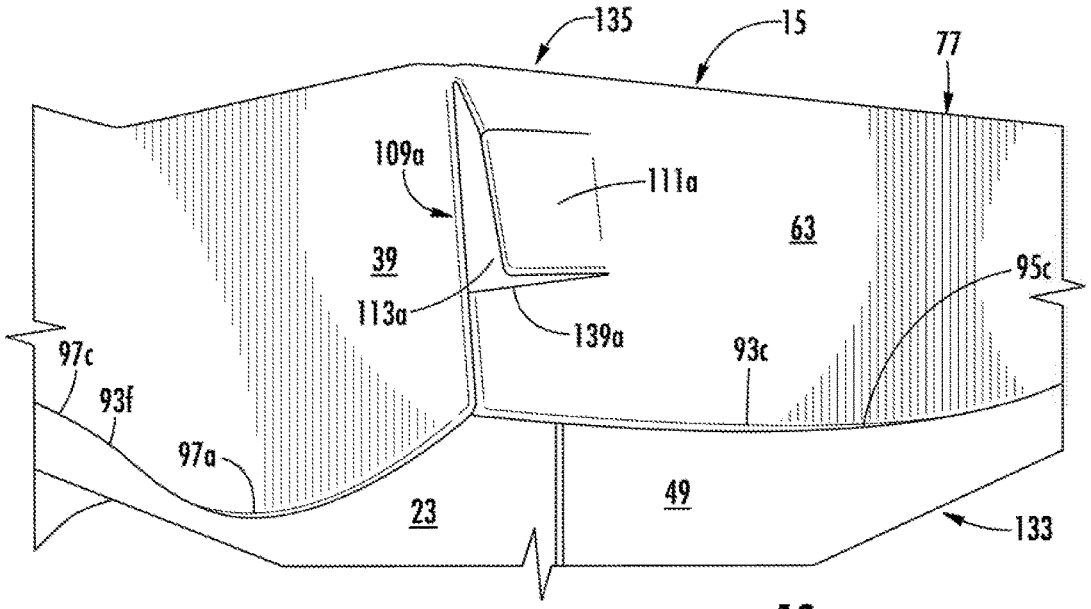
FIG. 10 is perspective view of a second exterior corner of a fully erected carton in a closed configuration according to an embodiment of the present disclosure.
Figure 11:
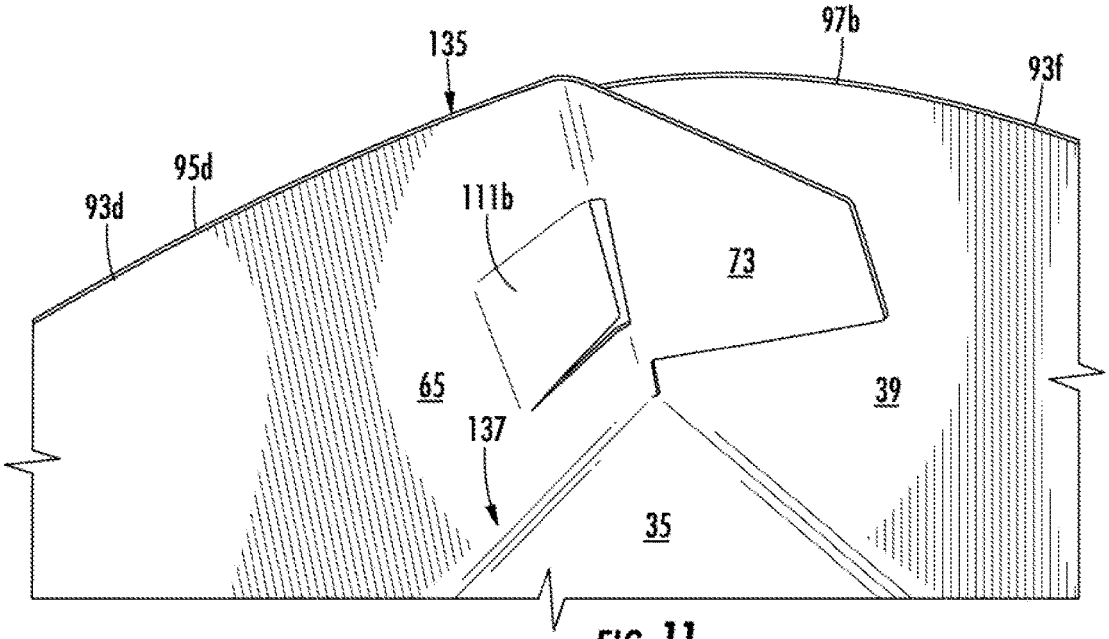
FIG. 11 is perspective view of a first interior corner of a fully erected carton in a closed configuration according to an embodiment of the present disclosure.
Figure 12:
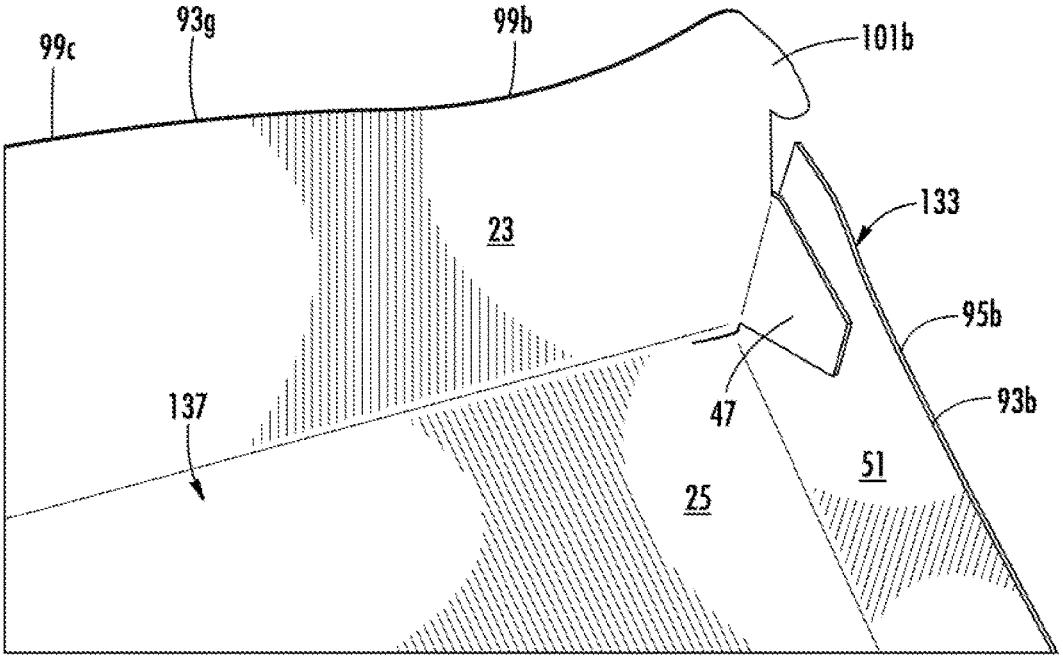
FIG. 12 is perspective view of a second interior corner of a fully erected carton in a closed configuration according to an embodiment of the present disclosure.

As illustrated in FIG. 5, the reclosable lid 135 comprises the top panel 35, the lid panel 39, the second back panel 32 and the end flaps 63, 65. The reclosable lid 135 is hingedly connected to the first back panel 31 along fold lateral fold line or hinge 34. The reclosable lid 135 is positionable in a closed (first) position wherein the lid panel 39 is positioned to at least partially overlap the front panel 23 and wherein the locking features 101*a*, 101*b*, 103*a*, 103*b* are engaged, preventing access to the interior of the carton 15. The reclosable lid 135 is positionable in an open (second) position wherein the releasable locks 109*a*, 109*b* are disengaged, allowing access to the interior of the carton 15. When the reclosable lid 135 is in the closed position, the locking tabs 101*a*, 101*b* extend from the front panel 23 and displace or flex the flaps 111*a*, 111*b* outwardly to form the openings 113*a*, 113*b*. The flexing of the flaps 111*a*, 111*b* provides clearance for receiving the locking tabs 101*a*, 101*b* as the lid 135 is closed. As illustrated in FIGS. 9 and 10, each of the openings 113*a*, 113*b* has a respective edge 139*a*, 139*b* and each tab 101*a*, 101*b* may engage the respective openings 111*a*, 111*b* and/or the respective edges 139*a*, 139*b* to hold the lid 135 in the closed position.

In one exemplary method of opening the carton 15, the front panel 23 is pushed inwardly generally at the center, releasing or disengaging the locking features 101*a*, 101*b*, 103*a*, 103*b*. The reclosable lid 135 is upwardly lifted and pivots at hinge or fold line 34 to the open position, as illustrated in FIG. 5. The carton 15 may be reclosed by positioning the reclosable lid 135 in the closed position by downwardly folding the lid 186 and pushing down on the top panel 35 such that the flaps 111*a*, 111*b* in the end flaps 63, 65 are brought into engagement with the locking tabs 101*a*, 101*b* extending from the front panel 23. As the locking tabs 101*a*, 101*b* slide past the flaps 111*a*, 111*b* and edges 139*a*, 139*b* an audible click is produced to provide feedback to the user that the locking features of the lid 135 are engaged. The foldable flaps 111*a*, 111*b* in the end flaps 63, 65 of the lid 135 also flex outwardly, extending the opening 113*a*, 113*b* to provide added space to accommodate the locking tabs 101*a*, 101*b* without deformation to the audible lock position. Also the flaps 111*a*, 111*b* may conceal or hide the locking tabs 101*a*, 101*b* for a clean aesthetic look.

In another exemplary method of opening the carton 15, a force may be applied to the lid panel 39. If the lid 135 is attempted to be opened by applying a force near the center of the lid panel 39 (e.g., attempting to lift the lid 135 by grasping near the center of the lid panel 39), the sides of the lid 135 comprising end flaps 63, 65 flex inwardly resulting in outward movement of the locking tabs 101*a*, 101*b* through the openings 113*a*, 113*b* and displacement of the flaps 111*a*, 111*b*, causing more surface area of the locking tabs 101*a*, 101*b* to be engaged by the edges 139*a*, 139*b*, and causing an increase in the locking force that resists the opening of the lid. However, to open the reclosable lid 135 and prevent the locking force increase, the opening force may be applied to any area substantially off center, such as the edges 141*a*, 141*b* (FIG. 7) of the lid 135. By applying the opening force off center, the sides of the lid 135 flex outwardly, allowing the notches 117*a*, 117*b* and the tabs 101*a*, 101*b* to clear the edges 139*a*, 139*b* and the flaps 111*a* and 111*b* allowing the lid to be raised. Further, an audible click may be produced as the tabs 101*a*, 101*b* disengage when the carton 15 is opened.

The carton 15 can be formed, closed, and/or opened by other alternative methods and steps without departing from the disclosure.

In general, the blank may be constructed from paperboard having a caliper so that it is heavier and more rigid than ordinary paper. The blank can also be constructed of other materials, such as cardboard, sheet plastics or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding thereabout. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carton panels in place, and is not intended to exclude heat, chemical, or frequency bonding techniques.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, the carton comprising:

a plurality of panels comprising a bottom panel, a front panel foldably connected to the bottom panel, at least one back panel, a top panel, and a lid panel foldably connected to the top panel;

at least one end flap foldably connected to a respective panel of the plurality of panels, the at least one end flap comprises an end flap foldably connected to the top panel;

a base comprising at least the bottom panel and the front panel;

a lid pivotably attached to the base, the lid comprising the top panel, the lid panel, and the end flap, the lid is movable between a closed position preventing access to the base and an open position allowing access to the base, wherein the lid panel overlaps the front panel when the lid is in the closed position; and locking features for releasably attaching the lid to the base in the closed position, the locking features comprising at least one male portion in the front panel and at least one female portion being at least partially formed in the end flap.

2. The carton of claim 1, wherein the at least one male portion comprises a projection extending from an upper corner of the front panel and a notch adjacent the projection.

3. The carton of claim 2, wherein the projection comprises a curved edge adjacent the notch, the curved edge engaging a portion of the at least one female portion when the carton in the closed position.

4. The carton of claim 1, wherein the at least one female portion includes at least one cut at least partially forming a locking flap foldably connected to end flap, the locking flap is displaced by the at least one male portion when the carton is in the closed position to create a locking opening in the end flap.

5. The carton of claim 4, wherein the at least one cut comprises two longitudinal cuts and a lateral cut extending between a respective end of each of the two longitudinal cuts.

6. The carton of claim 1, wherein the lid panel comprises a curved edge comprising a first convex portion, a second convex portion, and a concave portion connecting the first convex portion and the second convex portion.

7. The carton of claim 6, wherein the curved edge is a first curved edge and the concave portion is a first concave portion, the front panel comprises a second curved edge comprising a second concave portion, a third concave portion, and a third convex portion connecting the second concave portion and the third concave portion.

8. The carton of claim 1, wherein the at least one back panel comprises a first back panel foldably connected to the bottom panel, and a second back panel foldably connected to the first back panel and the top panel, the lid comprising the second back panel and being hingedly connected to the first back panel, and the base comprising the first back panel.

9. The carton of claim 1, wherein the end flap is a first end flap, the at least one end flap comprises a second end flap foldably connected to the bottom panel.

10. The carton of claim 9, wherein the first end flap has a concave edge and the second end flap has a convex edge.

11. The carton of claim 1, wherein the plurality of panels further comprises an attachment flap foldably connected to the end flap, the attachment flap being in face-to-face contact with the lid panel to attach the end flap to the lid panel and form a corner of the lid.

12. The carton of claim 1, wherein each of the front panel and the lid panel is disposed opposite to the at least one back panel.

13. The carton of claim 12, wherein the end flap extends from the at least one back panel to the lid panel.

14. The carton of claim 1, wherein the front panel is foldably connected to the bottom panel along a first fold line, the end flap is foldably connected to the top panel along a second fold line, and the first fold line and the second fold line are perpendicular to one another.

15. The carton of claim 1, wherein the front panel is foldably connected to the bottom panel along a first lateral fold line, the lid panel is foldably connected to the top panel along a second lateral fold line, and the end flap is foldably connected to the top panel along a longitudinal fold line.

16. The carton of claim 1, wherein the end flap extends from the at least one back panel toward the front panel when the carton is in the closed position.

17. A blank for forming a carton for holding at least one article, the blank comprising:

a plurality of panels comprising a bottom panel, a front panel foldably connected to the bottom panel, at least one back panel, a top panel, and a lid panel foldably connected to the top panel;

at least one end flap foldably connected to a respective panel of the plurality of panels, the at least one end flap comprises an end flap foldably connected to the top panel;

base features for forming a base in the carton formed from the blank, the base features comprising at least the bottom panel and the front panel;

lid features for forming a lid in the carton formed from the blank, the lid pivotably attached to the base, the lid features comprising the top panel, the lid panel, and the end flap, the lid is movable between a closed position preventing access to the base and an open position allowing access to the base, wherein the lid panel is for overlapping the front panel when the lid is in the closed position; and locking features for releasably attaching the lid to the base in the closed position, the locking features comprising at least one male portion in the front panel and at least one female portion being at least partially formed in the end flap.

18. The blank of claim 17, wherein the at least one male portion comprises a projection extending from an upper corner of the front panel and a notch adjacent the projection.

19. The blank of claim 18, wherein the projection comprises a curved edge adjacent the notch, the curved edge for engaging a portion of the at least one female portion when the carton in the closed position.

20. The blank of claim 17, wherein the at least one female portion includes at least one cut at least partially forming a locking flap foldably connected to the end flap, the locking flap is displaced by the at least one male portion when the carton is in the closed position to create a locking opening in the end flap.

21. The blank of claim 20, wherein the at least one cut comprises two longitudinal cuts and a lateral cut extending between a respective end of each of the two longitudinal cuts.

22. The blank of claim 17, wherein the lid panel comprises a curved edge comprising a first convex portion, a second convex portion, and a concave portion connecting the first convex portion and the second convex portion.

23. The blank of claim 22, wherein the curved edge is a first curved edge and the concave portion is a first concave portion, the front panel comprises a second curved edge comprising a second concave portion, a third concave portion, and a third convex portion connecting the second concave portion and the third concave portion.

24. The blank of claim 17, wherein the at least one back panel comprises a first back panel foldably connected to the bottom panel, and a second back panel foldably connected to the first back panel and the top panel, the lid features comprising the second back panel and the lid is for being hingedly connected to the first back panel, and the base features comprising the first back panel.

25. The blank of claim 17, wherein the end flap is a first end flap, the at least one end flap comprises a second end flap foldably connected to the bottom panel.

26. The blank of claim 25, wherein the first end flap has a concave edge and the second end flap has a convex edge.

27. The blank of claim 17, wherein the plurality of panels further comprises an attachment flap foldably connected to the end flap, the attachment flap being in face-to-face contact with the lid panel to attach the end flap to the lid panel and form a corner of the lid in the carton formed from the blank.

28. The blank of claim 17, wherein each of the front panel and the lid panel is disposed opposite to the at least one back panel.

29. The blank of claim 28, wherein the end flap extends from the at least one back panel to the lid panel.

30. The blank of claim 17, wherein the front panel is foldably connected to the bottom panel along a first fold line, the end flap is foldably connected to the top panel along a second fold line, and the first fold line and the second fold line are perpendicular to one another.

31. The blank of claim 17, wherein the front panel is foldably connected to the bottom panel along a first lateral fold line, the lid panel is foldably connected to the top panel along a second lateral fold line, and the end flap is foldably connected to the top panel along a longitudinal fold line.

32. The blank of claim 17, wherein the end flap extends from the at least one back panel toward the front panel when the carton formed from the blank is in the closed position.

33. A method of forming a carton, comprising:

obtaining a blank comprising a plurality of panels comprising a bottom panel, a front panel foldably connected to the bottom panel, at least one back panel, a top panel, and a lid panel foldably connected to the top panel, at least one end flap foldably connected to a respective panel of the plurality of panels, the at least one end flap comprises an end flap foldably connected to the top panel, the blank comprising base features, lid features, and locking features, the base features comprising at least the bottom panel, and the front panel, the lid features comprising the top panel, the lid panel, and the end flap, and locking features comprising at least one male portion in the front panel and at least one female portion at least partially formed in the end flap;

forming the base by positioning the front panel relative to the bottom panel;

forming the lid by positioning the lid panel relative to the top panel, the lid being pivotably attached to the base and movable between a closed position preventing access to the base and an open position allowing access to the base;

releasably attaching the lid to the base in the closed position by engaging the locking features, wherein the lid panel overlaps the front panel when the lid is in the closed position.

34. The method of claim 33, wherein the at least one male portion comprises a projection extending from an upper corner of the front panel and a notch adjacent the projection and the projection comprises a curved edge adjacent the notch, the releasably attaching comprises engaging the curved edge with a portion of the at least one female portion when the carton in the closed position.

35. The method of claim 33, wherein the at least one female portion includes at least one cut at least partially forming a locking flap foldably connected to the at least one end flap, the releasably attaching the lid to the base comprises displacing the locking flap by the at least one male portion when the carton is in the closed position to create a locking opening in the end flap.

36. The method of claim 35, wherein the releasably attaching the lid to the base comprises engaging the male portion with an edge of the locking opening.

37. The method of claim 33, wherein the lid panel comprises a first curved edge comprising a first convex portion, a second convex portion, and a first concave portion connecting the first convex portion and the second convex portion, the front panel comprises a second curved edge comprising a second concave portion, a third concave portion, and a third convex portion connecting the second concave portion and the third concave portion.

38. The method of claim 33, wherein the at least one back panel comprises a first back panel foldably connected to the bottom panel, and a second back panel foldably connected to the first back panel and the top panel, the lid features comprising the second back panel and the lid is hingedly connected to the first back panel, and the base features comprising the first back panel.

39. The method of claim 38, wherein the lid is connected to the base at hinge between the first back panel and the second back panel, the releasably attaching the lid to the base comprises pivoting the lid at the hinge from the open position to the closed position.

40. The method of claim 33, wherein the plurality of panels further comprises an attachment flap foldably connected to the end flap, the forming the lid comprises positioning the attachment flap being in face-to-face contact with the lid panel to attach the end flap to the lid panel and form a corner of the lid.

41. The method of claim 33, further comprising disengaging the locking features and moving the lid from the closed position to the open position.

42. The method of claim 33, wherein each of the front panel and the lid panel is disposed opposite to the at least one back panel.

43. The method of claim 42, wherein the end flap extends from the at least one back panel to the lid panel.

44. The method of claim 33, wherein the front panel is foldably connected to the bottom panel along a first fold line, the end flap is foldably connected to the top panel along a second fold line, and the first fold line and the second fold line are perpendicular to one another.

45. The method of claim 33, wherein the front panel is foldably connected to the bottom panel along a first lateral fold line, the lid panel is foldably connected to the top panel along a second lateral fold line, and the end flap is foldably connected to the top panel along a longitudinal fold line.

46. The method of claim 33, wherein the end flap extends from the at least one back panel toward the front panel when the carton is in the closed position.

* * * * *